United States Patent [19]

Olsen, Jr. et al.

[11] Patent Number: 4,693,055

[45] Date of Patent: Sep. 15, 1987

[54] METHOD AND APPARATUS FOR FEEDING CONTAINERS TO A CARRIER SLEEVE

[75] Inventors: Peter C. Olsen, Jr.; Peter M. Conforto, both of Monroe, La.; David L. Wolf, Cedar Falls, Iowa; Donald R. Hudson, West Monroe, La.

[73] Assignee: Manville Corporation, Denver, Colo.

[21] Appl. No.: 915,479

[22] Filed: Oct. 6, 1986

Related U.S. Application Data

[63] Continuation-in-part of Ser. No. 861,774, May 9, 1986, abandoned.

[51] Int. Cl.[4] ..... B65B 21/06

[52] U.S. Cl. ..... 53/443; 53/48; 53/237; 53/251; 53/467; 53/534; 53/566; 198/419; 198/425

[58] Field of Search ..... 53/48, 154, 251, 237, 53/284, 443, 534, 543, 566, 467, 468, 475; 198/425, 419

[56] References Cited

U.S. PATENT DOCUMENTS

| | | | |
|---|---|---|---|
| 3,300,947 | 1/1967 | Fahrenbach | 53/48 |
| 3,572,004 | 3/1971 | Carmichael | 53/48 |
| 3,778,959 | 12/1973 | Langen et al. | 53/48 |
| 3,956,868 | 5/1976 | Ganz et al. | 53/566 |
| 3,990,572 | 11/1976 | Fishback | 198/419 |
| 4,237,673 | 12/1980 | Calvert et al. | 53/48 |
| 4,360,098 | 11/1982 | Nordstrom | 198/425 |

*Primary Examiner*—Robert L. Spruill
*Assistant Examiner*—Donald R. Studebaker
*Attorney, Agent, or Firm*—John D. Lister; Cornelius P. Quinn; Timothy R. Schulte

[57] ABSTRACT

A machine for feeding beverage cans to open-ended carrier sleeves of varying capacities. When loading relatively small carrier sleeves, inboard conveyors and associated metering screws feed groups of cans to a flight bar conveyor which moves the groups through the open ends of the carrier sleeves. When loading relatively large carrier sleeves, outboard conveyors and associated metering screws are also operated after first replacing the inboard screws with screws able to separate cans into larger groups, the same size as those formed by the outboard screws. This arrangement feeds larger groups of cans which are then fed to the larger carrier sleeves. In one embodiment each conveyor comprises a longer upstream conveyor and a shorter downstream conveyor spaced a short distance therefrom to allow the flight bars to travel through the space between the conveyors when moving from the end of their upward run to the beginning of their horizontal downstream run. In another embodiment only the longer upstream conveyor is provided and a support plate is used instead of the downstream conveyor. In this embodiment the gap between the conveyor and the plate is automatically closed by a shuttle mechanism to provide a continuous support surface for the cans as they are pushed toward the carrier sleeves. The cans are able to slide on the surface of the conveyors, enabling the conveyors to be operated at a slightly greater speed than the screws are capable of moving the cans, which results in the cans being positively fed by the conveyors.

28 Claims, 11 Drawing Figures

Fig. 6
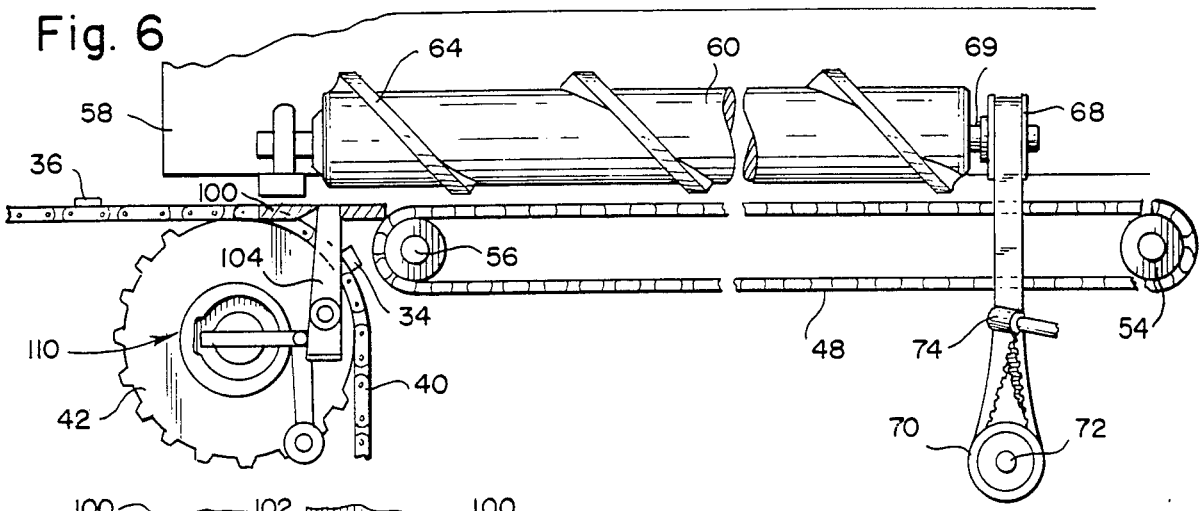
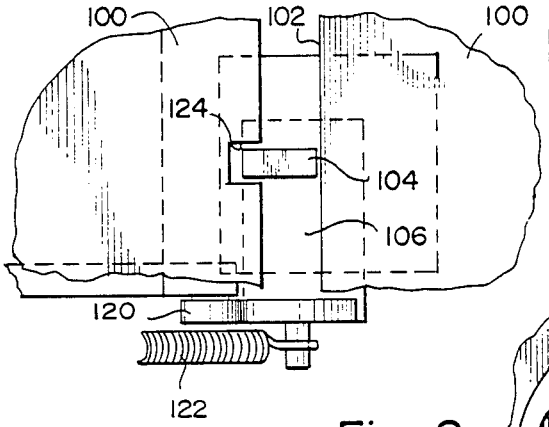
Fig. 7
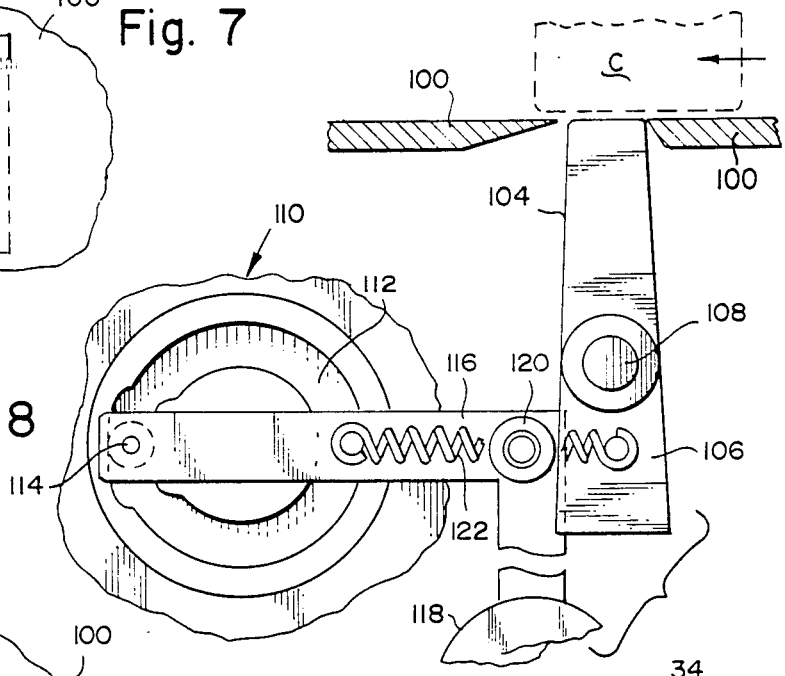
Fig. 8
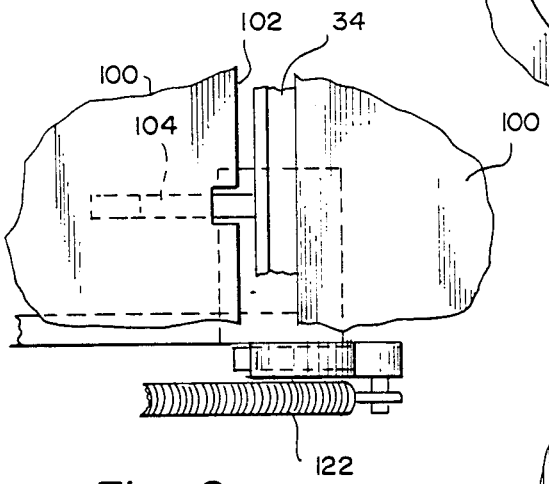
Fig. 9
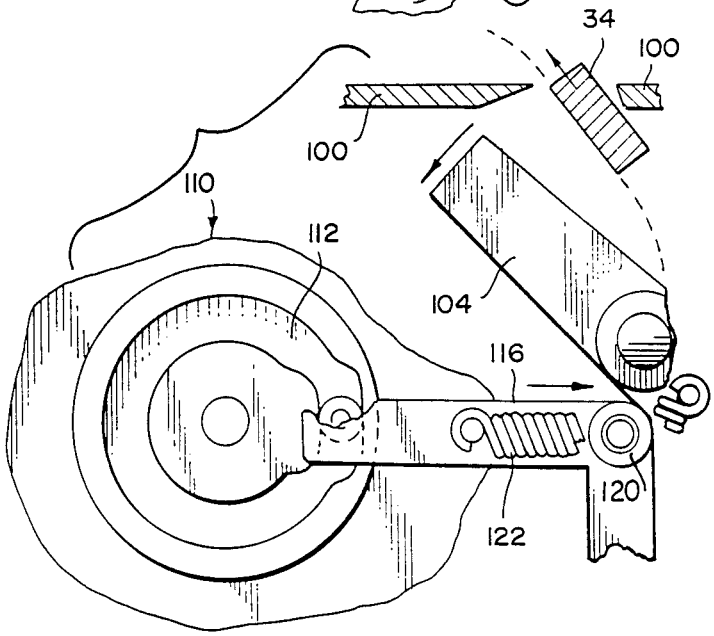
Fig. 10

METHOD AND APPARATUS FOR FEEDING CONTAINERS TO A CARRIER SLEEVE

CROSS REFERENCE TO RELATED APPLICATION

This application is a continuation-in-part of application Ser. No. 861,774 filed May 9, 1986, now abandoned.

FIELD OF THE INVENTION

This invention relates to the feeding of containers in a packaging machine, and more particularly it relates to a method and apparatus for feeding and loading carrier sleeves of different capacities.

BACKGROUND OF THE INVENTION

One type of carrier commonly used to package twelve or twenty-four beverage cans is formed from a generally rectangular paperboard blank which is folded and glued by the blank manufacturer into a sleeve-like configuration. The blanks are then shipped to bottling plants in generally flat collapsed condition where they are opened into sleeve form, loaded through their open ends with cans, and closed by folding and sealing the end flaps in place. These operations are performed automatically at very high speeds and unless precisely controlled can become snarled. One sensitive area of control is the beverage can sorting and feeding mechanism for feeding six cans from each side into the sleeve when loading a carrier designed to hold twelve cans. The same problems are present when feeding twelve cans from each side when loading a carrier designed to hold twenty-four cans or when feeding any desired number of cans from each side when loading a carrier designed to hold twice that number. Although it would be desirable to be able to load both sizes of carriers on the same packaging machine, this requires a machine whose can feed mechanism is not only fast and reliably able to segregate the cans into groups of the correct number for loading, but one which also can be quickly converted from running one size carrier to the other. Until this invention, such a machine has not been available.

BRIEF SUMMARY OF THE INVENTION

This invention provides a screw metering and separating means for use in conjunction with a can feed conveyor for feeding the correct number of cans to a flight bar conveyor. Inboard conveyor and screw metering means are provided for loading relatively small carriers, and separate outboard conveyor and screw metering means are also operated when loading relatively large carriers. In order to keep the cans moving rapidly the screw means does not positively move the cans through the machine, the conveyor means being provided for this purpose. In addition, in one embodiment the conveyor and screw arrangement is designed so that the flight bars contact the trailing cans in each segregated group of cans before the cans leave the conveyor feed means, thus assuring a positive feed throughout their passage through the machine. In another embodiment the gap in the base plate through which the flight bars pass as they make the change from vertical to horizontal travel is automatically closed to provide a continuous support for the moving cans.

These and other features and aspects of the invention, as well as its various benefits, will be made more clear in the detailed description of the invention which follows.

BRIEF DESCRIPTION OF THE DRAWINGS

FIG. 6 is a view similar to that of FIG. 5, but showing another embodiment designed to automatically close the gap in the can support plate through which the flight bars pass;

FIG. 7 is a partial plan view of the can support plate at the point where the gap is closed by the mechanism of this embodiment;

FIG. 8 is a partial sectional view of the gap closing mechanism of FIG. 7;

FIG. 9 is a view similar to that of FIG. 7, but showing the gap in open condition, with the flight bar passing therethrough;

FIG. 10 is a view similar to that of FIG. 8, but showing the gap closing mechanism of FIG. 9 in open condition.

DESCRIPTION OF THE INVENTION

Figure 1:
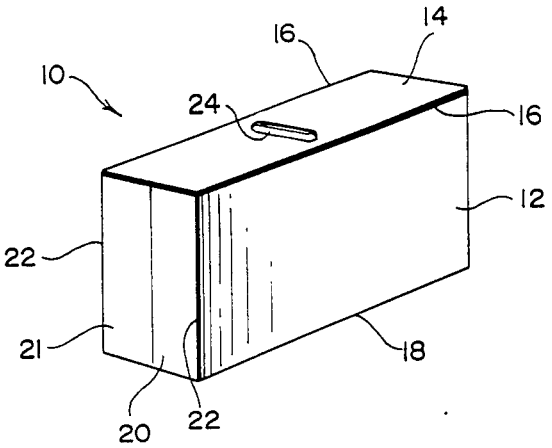
FIG. 1 is a pictorial representation of a carrier which has been formed from a sleeve and which is commonly used to hold twelve or twenty-four beverage cans depending upon its size.

Referring to FIG. 1, a carrier 10 of the type which the machine of this invention is designed to load has side panels 12 connected to a top panel 14 by folds 16 and to a bottom panel, not shown in this view, by folds 18. End flaps 20 and 21, connected to the side panels by folds 22, are glued against dust flaps foldably connected to the top and bottom panels to form the end panels of the carrier. A handle opening 24 in the top panel permits the consumer to grip and carry the carrier.

Figure 2:
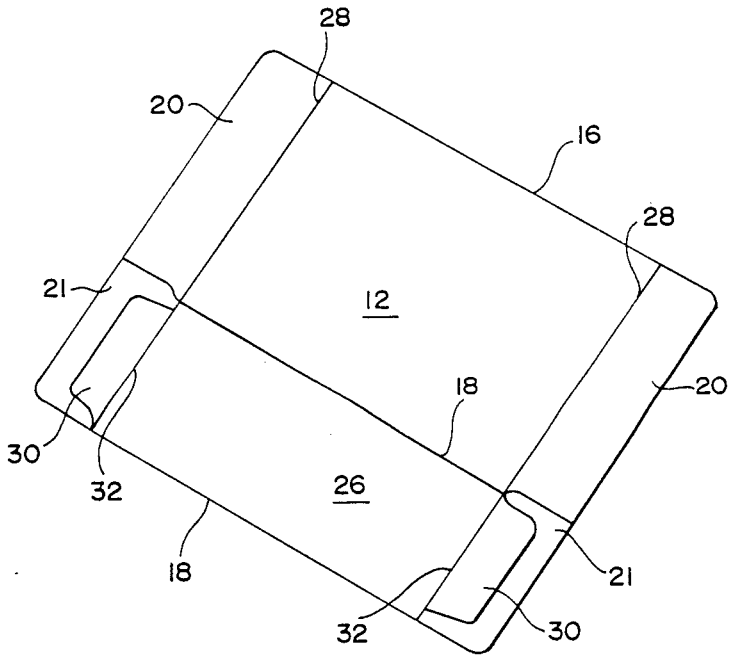
FIG. 2 is a pictorial representation of a collapsed carrier sleeve which when opened forms the carrier sleeve of FIG. 3.

To make the carrier 10, a generally rectangular blank is folded and glued to form the collapsed carrier sleeve shown in FIG. 2. The sleeve comprises an upper side panel 12 connected to the bottom panel 26 by fold line 18 and to upper end flaps 20 by fold lines 28. The top panel is not visible in this view but is connected to the upper side panel 12 by fold line 16 and is folded back against the underside of the upper side panel 12. Similarly, the lower side panel is folded back against the underside of the bottom panel 26 and against a portion of the underside of the upper side panel, the lower side panel being connected to the bottom panel 26 by the other fold line 18. The dust flaps 30 are connected to the bottom panel 26 by fold lines 32. Similar dust flaps are connected to the upper panel, not shown in this view.

Figure 3:
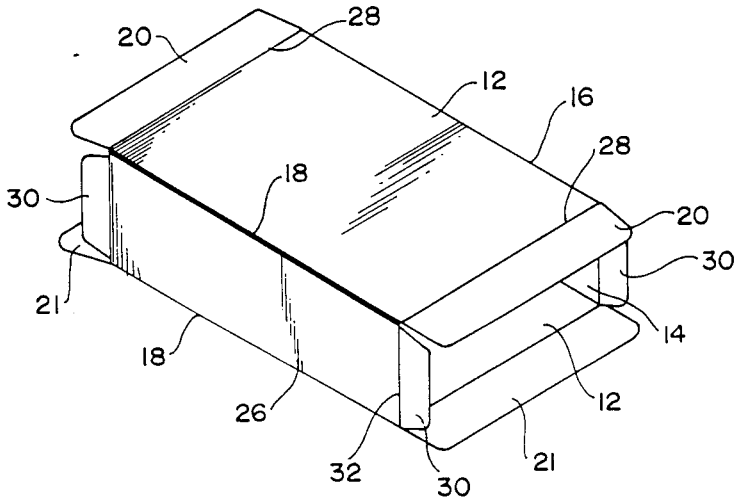
FIG. 3 is a pictorial representation of an open carrier sleeve used to form the carrier of FIG. 1.

The collapsed sleeve of FIG. 2 is opened to the configuration shown in FIG. 3 by the packaging machine in preparation for the loading process. As can be seen, the sleeve is rectangular in cross section, the side, bottom and top panels of the collapsed sleeve having been pivoted about their fold lines during the opening process. Six cans are then loaded into the sleeve through either open end to form a twelve-pack carrier or twelve cans are loaded to form a twenty-four-pack carrier. The dust flaps 30 are then folded over and the end flaps 20 and 21 are folded and glued to the dust flaps to form the fully enclosed carrier shown in FIG. 1.

Figure 4:
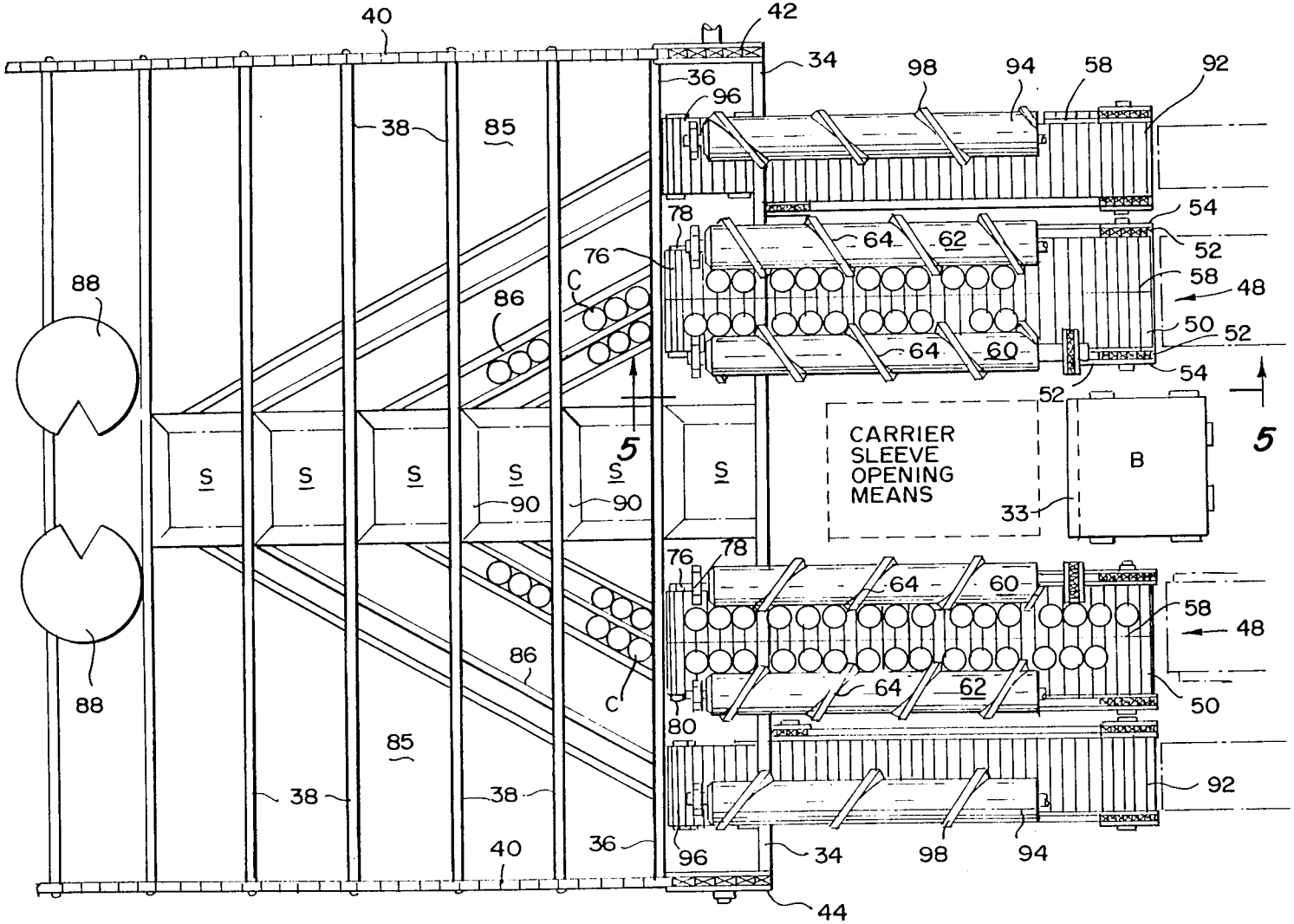
FIG. 4 is a schematic plan view of the container feeding apparatus of the present invention.

Referring to FIG. 4, a stack of collapsed carrier sleeves B are shown in a hopper 33. The lowermost sleeve in the hopper is removed by means well known in the art, such as by an oscillating suction device, and is moved through a sleeve opening area where it is folded into an open sleeve of the type shown in FIG. 3. Any of the many known opening means can be used to open the collapsed sleeve, so long as the sleeve is in open condition when the cans or other containers are ready to be inserted into the open sleeve. For purpose of this disclosure, the open sleeve S is shown as having been deposited in the pocket formed by flight bars 34 and 36, the last two flight bars to have moved up from their return run to begin their downstream horizontal run toward the left side of the drawing. Other open sleeves S are shown in the pockets formed by the other flight bars 38. While being pushed by the flight bars the open sleeves are supported by a support surface, not shown, in a manner well known in the art. The flight bars are attached at their ends to continuous chains 40 trained about sprockets 42 and 44, shown in FIG. 4, and about sprockets 46, shown in FIG. 5 as being beneath the upper horizontal run of the chain and vertically beneath the sprockets 42 and 44.

Figure 5:
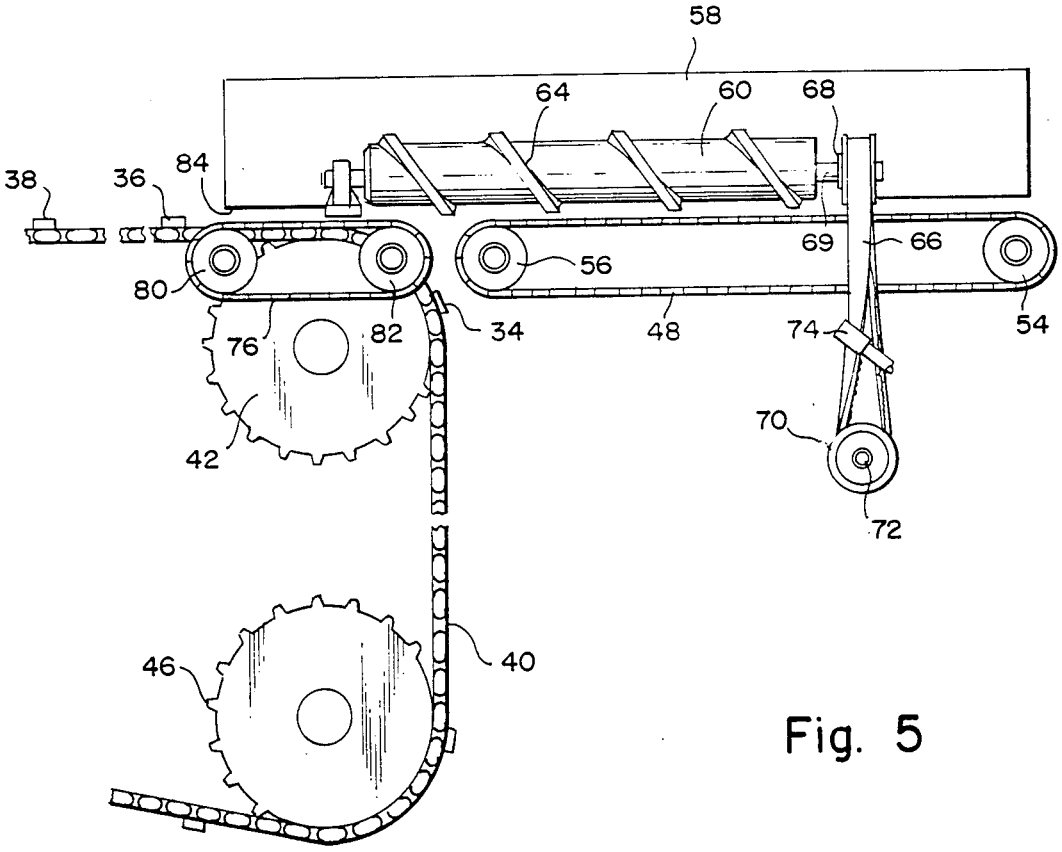
FIG. 5 is a view taken on line 5—5 of FIG. 4.

Referring to FIGS. 4 and 5, endless conveyors 48 for transporting beverage cans or other containers are located on either side of the hopper 33 and the carrier sleeve opening section. The conveyors preferably comprise rigid support plates or slats 50 connected at their ends to chains 52 which in turn are trained about sprockets 54 and 56. If preferred, the conveyors could instead be connected to chains at points located between the ends of the support plates, and in fact only a single centrally located chain can be employed if desired. The surface of the plates that contacts the cans is preferably relatively smooth or slippery so that the cans are able to slide along the surface, as will be explained in more detail later. Supported just above the middle and extending along the length of each conveyor 48 is a separator plate 58 which allows the conveyor to feed two rows of cans without interfering with each other.

Mounted just above the outer edge portions of each conveyor 48 and extending from a point located a short distance downstream from the inlet end of the conveyor to a point a short distance beyond the downstream end of the conveyor are screws 60 and 62. Each screw contains spiral vanes 64 which are configured so that they engage every third can in the row of cans contacted by the screw. Each screw is driven by a belt 66 trained over a sprocket 68 on the end of screw shaft 69 and over a sprocket 70 mounted on a common drive shaft 72. This arrangement is shown in FIG. 5, but for the sake of clarity not in FIG. 4. The belt may also be in contact with an adjustable tension wheel 74 mounted at an angle to the shafts for setting the proper amount of tension on the belt. Preferably, the shaft 72 is driven off the shaft which drives either sprocket 54 or 56 in order to correlate the speeds of the conveyors 48 and the screws 60 and 62.

Another conveyor 76 similar in construction to but shorter than conveyor 48 is located downstream from conveyor 48. This conveyor has chains 78 trained about sprockets 80 and 82 and the speed of the conveyor is the same as the speed of the conveyor 48. The two conveyors are spaced from each other only enough to permit the flight bars 34, 36 and 38 to travel between them as the flight bar chain 40 changes direction during its movement around sprockets 42 and 44. Ideally, this should be close enough to permit the beverage cans to move from the conveyor 48 to conveyor 76 without a support plate between the conveyors. The separator plate 58 continues to the downstream end of the conveyor 76 to provide the same function for this conveyor run as it does for the conveyor 48. The bottom of the plate 58 is notched as at 84 to provide space for the flight bars to travel while vertically spaced above the conveyor 76 during their horizontal run in a downstream direction. Obviously, if desired, instead of providing a single wide conveyor to transport two rows of cans, thus necessitating a separator plate between rows, two narrower conveyors could be used without a separator plate.

In operation, cans are fed to the conveyors 48 by any suitable feeding means and two rows of cans C, separated by plate 58, are transported by each conveyor 48. When the cans reach the screws 60 and 62, their spiral vanes 64 contact every third can to thereby separate the rows of cans into groups of three. The speed of the conveyor 48 is correlated to the speed at which the rotating screws would on their own move the cans downstream, but preferably is slightly faster. Since, however, the cans can move no faster than the metering screws allow them to move, the cans are not able to move at the slightly higher speed of the conveyor, which causes the conveyor to have a slight downstream sliding movement relative to the cans. The smooth surface of the conveyor support plates enables this to happen. In this way the cans are positively fed by the conveyor, not by the screws, and the screws primarily perform a metering and segregating function. Of course other types of conveyors, such as a belt conveyor, could also be used if the can support surface can be made relatively smooth or slippery.

As the third can in a group passes over the gap between the conveyors 48 and 76, a flight bar 34 moves up through the gap and contacts the back of the third can, staying in contact with it as the conveyor 76 continues to move the cans over its short run. Continued movement of the flight bar pushes the rows of three cans over the support surface 85 after the cans leave the conveyor 76, the direction of movement of the cans being controlled by lane guides 86, causing the cans to move diagonally downstream until they converge with and are pushed into the open sleeves S in a manner well known in the art. The filled sleeves move downstream and the end flaps are closed and adhered to the dust flaps to complete the fabrication of the filled carrier by means not shown but well known in the art. Although the rails for folding the flaps into their proper position are not shown, the wheels for closing the leading dust flaps and folding the trailing dust flap are indicated at 88. The gluing operation for adhering the end flaps to the dust flaps would occur downstream from the flap closure wheels.

Even though the distance between the conveyors 48 and 76, in the arrangement shown in FIG. 5, is kept to a minimum, the gap which must be bridged by the moving cans can at times cause problems in maintaining a smooth flow of cans. Specifically, the problem can originate with the manner in which the cans are contacted by the screw 60. The cans are engaged by the screw vanes 64 closer to the tops of the cans than to the bottoms, which tends to tip the cans forward as they cross the gap between conveyors. Although it is possible to put a stationary plate between the conveyors to close as much of the gap as practicable, this expedient does not fully solve the problem because the width of the gap that must still be left open in order for the flight bars to pass through is still sufficiently wide to permit the snagging or toppling of the cans to occur. Nor is it possible in a machine of normal width to narrow the flight bars in order to reduce the width of the gap. The reduction in size of the flight bars in order to make enough of an impact on the width of the gap to solve the can toppling problem would make the bars too flimsy to hold up against the rigors of continuous operation.

Another aspect of the invention, shown in detail in FIGS. 6 to 10, corrects the problem in a simple yet effective way. Referring to FIG. 6, the screw 60, the upstream conveyor 48 and the drives for the screw and the conveyor are the same as described in connection with FIG. 5. Instead of a downstream conveyor, however, a support plate 100 is provided just downstream from the conveyor 48 so as to allow little or no substantial gap between the plate and the conveyor. But, as shown in FIG. 7, even with the plate 100, a slot or gap 102 must be provided to allow passage of the flight bars. The possibility of the cans toppling while traversing the gap 102 would still be a problem. As seen in FIG. 6, and more particularly in FIGS. 7 and 8, a finger 104 is provided to fill the gap 102 at the point where the centers of the cans pass over the gap. As shown in FIG. 8, the end of the finger 104 is at substantially the same level as the upper surface of the plate 100 so that a can C will slide over it as if it were a continuation of the plate 100, thus having no tendency to topple.

The finger 104 extends upwardly from arm or bar 106 which is pivoted at 108. Cam 110, mounted adjacent arm 106, has a cam track or groove 112. Riding in the cam track 112 is cam follower 114 which is mounted on one end of angle arm 116. The other end of the angle arm 116 is pivoted to the frame at 118, shown partially in FIG. 8 and in full in FIG. 6. At the angled portion of the angle arm 116 a roller 120 is mounted so that it is in constant engagement with the near side of the arm 106 by virtue of the biasing force of the spring 122 attached at one end to the angle arm 116 and at the other end to the arm 106.

In the position of the elements shown in FIGS. 6, 7 and 8, the arm 104 is in its upright gap closing condition. Preferably the plate 100 is slotted or notched at the downstream side of the gap 102 as indicated at 124, and the gap closing end surface of the finger 104 is dimensioned to extend up close to the edge of the notch 124. This arrangement helps ensure that the cans will not snag the downstream edge of the gap 102 because the leading edge of a can will still be receiving support from the finger end when it passes over the downstream edge of the gap adjacent the notch 124.

When a flight bar is ready to move through the gap 102 the operation of the cam 110 pushes the horizontal leg of the angle arm 116 to the right, causing it to pivot about its pivot point 118. This in turn pushes against the lower portion of the bar 106, causing it to pivot or rotate about its pivot point 108. The finger 104 turns with the pivot 108 to move the end of the finger away from the gap to make way for the passage of the flight bar 34. The flight bar 34 is shown in FIGS. 9 and 10 as it is moving through the gap 102, with the finger 104 having been moved to the left. If desired, the bottom portions of the plate 100 at the edges of the gap 102 can be chamfered or beveled as illustrated to facilitate the movement of the finger 104 and the flight bar 34 past the edges of the gap.

As extra insurance against the possibility of a failure of the mechanism to swing the finger 104 out of the way of the flight bar, this arrangement further permits the finger to be pivoted out of its upright closed position by the flight bar itself. In such an event the finger would be moved to the left, as viewed in the drawings, against the force of the spring 122, and as soon as the flight bar passed through the gap, the spring would restore the finger to its upright position once again. While the machine could operate in this manner it is much preferred that the gap closing finger be moved away from the gap by a positive means to eliminate the wear on the flight bars and finger which would otherwise result.

It should be understood that the arm or bar 106 can continue across the width of the machine in order to support as many gap closing fingers as there are lanes of moving cans. Although it may be possible to design a gap closing mechanism for use in conjunction with two adjacent conveyors arranged as in FIG. 5, it is preferred not to do so because of the difficulty in providing the gap closing mechanism in such close proximity to the downstream conveyor and its drive. It is therefore preferred to use a support plate downstream from the conveyor 48 as shown in FIG. 6.

Referring now to FIG. 4, it will be noted that the pocket formed between flight bars extends from the leading face of the trailing flight bar to an insert 90 attached to the trailing face of the leading flight bar. This arrangement shortens the pocket length between bars to fit the dimensions of a relatively small size carrier, such as one for carrying twelve beverage cans, the size that would be used to hold the six cans fed into each side of the open sleeves as described above. If it is desired to load a relatively large carrier, such as one for carrying twenty-four beverage cans, the same machine can be used after making a few simple and rapid changes. First, the conveyors 92 and associated screws 94, located outboard of the conveyors 48 and screws 64, would be activated. The conveyors 92 are similar to the conveyors 48 but are narrower since they are designed to transport only a single row of cans. Associated with each conveyor 92 is a shorter conveyor 96 similar to the short conveyors 76 but, as in the case of the conveyor 92, being narrower. The screws 94 are similar to the screws 60 and 62, but instead of having spiral vanes designed to meter and group three beverage cans together, the vanes 98 are designed to meter and group four cans.

Figure 11:
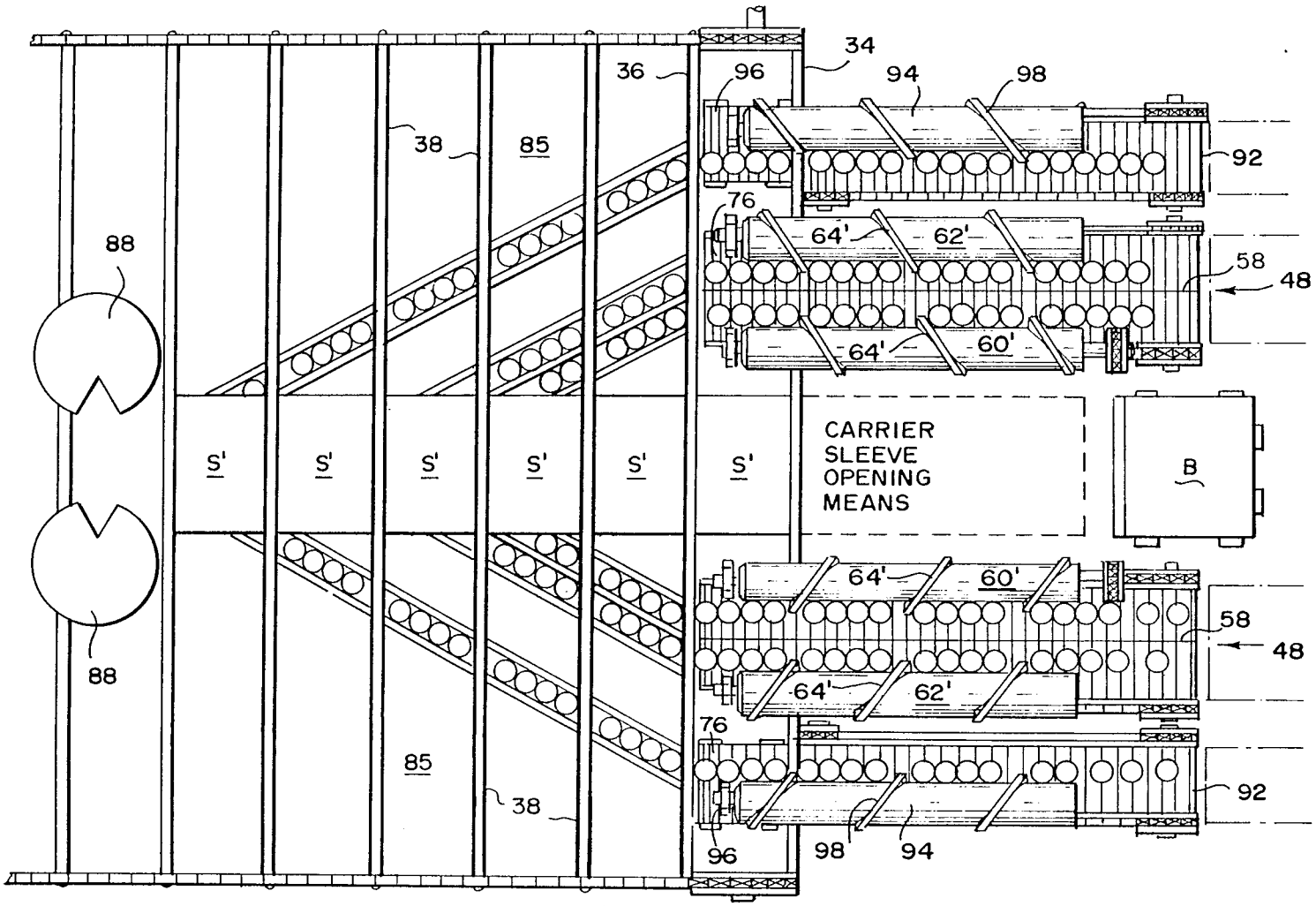
FIG. 11 is a schematic plan view similar to that of FIG. 4 but showing the outboard conveyor means in operative condition.

As shown in FIG. 11, when used to load a twenty-four-pack carrier, the conveyors 48 and 76 would remain the same but the screws 60 and 62 would be replaced by new screws 60' and 62'. The difference between screws 60 and 60' and between screws 62 and 62' is that the vanes 64' are designed to meter and group together four beverage cans instead of three. Thus all of the screws in this arrangement would cause the conveyors 48 and 92 to deliver groups of four cans to the flight bars. As shown in FIG. 11, three rows of four cans each would be delivered to and loaded into each end of the open sleeves S', making a total of twenty-four cans that would be loaded into the sleeve. When loading such relatively large size sleeves, the inserts 90 from the FIG. 4 arrangement would be removed and the pockets in which the sleeves reside would consist simply of the confines between the leading face of the trailing flight bar and the trailing face of the leading flight bar. The time necessary to activate the conveyors 92 and 96, replace the screws 60 and 62 with screws 60' and 62', and remove the inserts 90 from the flight bars 38 is very little, yet the same machine can be used to handle a carrier of twice the capacity of the smaller carrier. If desired, the creation of smaller pockets need not be carried out by the use of inserts 90, but could instead be formed by simply adding additional flight bars. Inserts are preferred, however, because of the speed with which they can be attached and removed.

Obviously, the invention is not limited to the loading of either twelve or twenty-four cans to a carrier. Using the same principles, other loadings could be made. For example, the two major conveyor and screw feeds could be used to deliver four cans each to each end of an open sleeve to produce a carrier containing sixteen cans, or all three conveyor and screw feeds could be used to deliver three cans each to each end of an open sleeve to produce a carrier containing eighteen cans. Still other loading arrangements will be apparent to those skilled in the art.

It should further be understood that while the apparatus has been described mainly in connection with the loading of beverage cans into a carrier, other type of containers could also be handled, so long as the portion engaged by the screws is generally cylindrical in shape, enabling the containers to be handled in the same general manner as beverage cans.

It should now be clear that the present invention provides a machine which can be readily and simply converted from handling one size of open sleeve carrier to another without changing the principles of operation and without a very long change-over procedure. The containers are always under positive feed while being metered, and the same flight bar arrangement used to move the open sleeves through the loading section is also used to move the containers to the open sleeves, thereby assuring a properly timed and uniform delivery sequence.

It should also be obvious from the foregoing that although preferred embodiments of the invention have been described, it is possible to make changes to certain specific details of the machine without departing from the spirit and scope of the invention.

What is claimed is:

1. Apparatus for feeding containers, a substantial portion of each container being cylindrical is shape, to an open-ended carrier sleeve moving in a downstream direction along a support surface, comprising:

conveyor means for moving the containers downstream in a row on either side of an generally parallel to the direction of movement of the carrier sleeves, container support means aligned with and spaced downstream from the conveyor means for continuing the movement of the containers, screw means mounted parallel to and extending along substantial portions of the conveyor means so as to engage the containers and separate them into groups containing a predetermined number of containers while the containers are being moved by the conveyor means, a flight bar conveyor having an upward run which moves the flight bars through the space between the downstream end of the conveyor means and the upstream end of the container support means, and a generally horizontal run which moves the flight bars downstream vertically spaced above the container support means, the flight bar contacting containers on the container support means and pushing them along the container support means during the generally horizontal run of the flight bar conveyor, means for holding an open-ended carrier sleeve in the pocket formed by successive flight bars during the generally horizontal run of the flight bar conveyor, and means for moving the containers into the carrier sleeves through the open ends thereof.

2. Apparatus according to claim 1, wherein the flight bars contact the back of the last container in a group and remain in contact therewith during the travel of the containers on the container support means.

3. Apparatus according to claim 2, wherein the screw means remains in contact with at least the last container in a group at least until a flight bar contacts the last container.

4. Apparatus according to claim 1, wherein the conveyor means moves at a slightly faster speed than the speed at which the screw means can move the containers and wherein the surface of the conveyor means supporting the containers is relatively slippery, allowing the containers to slide thereon, whereby the conveyor means positively feeds the containers and the screw means provides a metering function.

5. Apparatus according to claim 1, wherein the means for moving the containers into the carrier sleeves through the open ends thereof includes guide rails for directing the container groups toward the carrier sleeves as the flight bars move the containers downstream from the container support means.

6. Apparatus according to claim 1, wherein the width of the conveyor means is sufficient to support two rows of containers thereon, and wherein the conveyor means includes separator means for keeping the containers in one row from contacting the containers in the other row.

7. Apparatus according to claim 1, wherein the container support means comprises second conveyor means.

8. Apparatus according to claim 1, including additionally means for bridging the space between the downstream end of the conveyor means and the upstream end of the container support means along the path of movement of the cans when said space is not occupied by a flight bar, whereby the bridging means supports the containers as they move from the conveyor means to the container support means.

9. Apparatus according to claim 8, wherein the bridging means comprises a finger the outer end of which bridges the aforesaid space, the finger being spring biased into bridging position.

10. Apparatus according to claim 9, including additionally cam means for moving the finger out of bridging position and maintaining the finger in nonbridging position while a flight bar is moving through the aforesaid space.

11. Apparatus according to claim 9, wherein the finger can be moved out of bridging position by a flight bar coming into contact therewith during the normal passage of the flight bar along the path of travel thereof.

12. Apparatus for feeding containers, a substantial portion of each container being cylindrical in shape, to an open-ended carrier sleeve moving in a downstream direction along a support surface, comprising:

inboard conveyor means for moving the containers downstream in a row on either side of and generally parallel to the direction of movement of the carrier sleeves, outboard conveyor means for moving the containers downstream in a row parallel to but spaced outwardly from the inboard conveyor means, screw means mounted parallel to and extending along substantial portions of the inboard and outboard conveyor means so as to engage the containers and separate them into groups containing a predetermined number of containers while the containers are being moved by the conveyor means, the inboard conveyor means and the associated screw means thereof being adapted to run independently of the outboard conveyor means and the associated screw means thereof to move containers in groups having a predetermined number of containers therein, both the inboard and outboard conveyor means and their associated screw means also being adapted to run at the same time to move containers in groups having a predetermined number of containers therein, means for moving the open-ended carrier sleeves downstream, and means for moving the containers into the carrier sleeves through the open ends thereof.

13. Apparatus according to claim 12, wherein the screw means of the inboard conveyor means when run independently of the outboard conveyor means separates the containers into groups comprised of a different number of containers than the number of containers separated thereby when the inboard and outboard conveyors are run at the same time.

14. Apparatus according to claim 12, wherein the means for moving the open-ended carrier sleeves downstream comprises a flight bar conveyor, successive flight bars forming a pocket therebetween for holding an open-ended carrier sleeve.

15. Apparatus according to claim 14, wherein the means for moving the containers into the carrier sleeves through the open ends thereof includes guide rails for directing the container groups toward the carrier sleeves as the flight bars move the containers downstream.

16. Apparatus according to claim 14, wherein each inboard conveyor means and each outboard conveyor means comprises a relatively long conveyor and a relatively short conveyor spaced a short distance downstream therefrom, the flight bar conveyor having an upward run which moves the flight bar between the adjacent ends of the relatively long and short conveyors just prior to the flight bar conveyor beginning its horizontal downstream run.

17. Apparatus according to claim 14, wherein each inboard conveyor means and each outboard conveyor means comprises a conveyor the downstream end of which terminates a short distance upstream from a container support plate, the flight bar conveyor having an upward run which moves the flight bars through the space between the adjacent ends of the conveyor and the container support plate just prior to the flight bar conveyor beginning its horizontal downstream run, and means for bridging said space along the path of movement of the cans when the space is not occupied by a flight bar, thereby supporting the containers as they move from the conveyor to the conveyor support plate.

18. Apparatus according to claim 13, wherein the means for moving the open-ended carrier sleeves downstream comprises a flight bar conveyor, successive flight bars forming a pocket therebetween for holding an open-ended carrier sleeve, and means for reducing the size of the pocket when the outboard conveyor means are not operating.

19. Apparatus according to claim 18, wherein the means for reducing the size of the pocket comprises inserts attached to the flight bars to reduce the distance between flight bars.

20. A method of feeding containers, a substantial portion of each container being cylindrical in shape, to an open-ended carrier sleeve moving in a downstream direction along a support surface, comprising the steps of:

moving open-ended carrier sleeves in the pockets formed by successive flight bars of a flight bar conveyor during the downstream run of the flight bar conveyor, moving the containers in a row on conveyor means located upstream from the flight bar conveyor and on either side of and generally parallel to the direction of movement of the carrier sleeves, contacting the containers with screw means to separate the containers into groups of a predetermined number while the containers are being moved by the conveyor means, moving the flight bars upwardly to the downstream ends of the conveyor means just prior to the downstream run of the flight bar conveyor, contacting the last container in each group of containers with a flight bar substantially as the flight bar is changing direction from the upward run thereof to the downstream run thereof, moving the containers on support means spaced downstream from the conveyor means a distance allowing the flight bars to move up between the conveyor means and the support means and to move downstream vertically spaced above the support means, pushing the groups of containers by means of the flight bars past the support means along a support surface, and moving the groups of containers into the carrier sleeves through the open ends thereof.

21. A method according to claim 20, wherein the flight bars push the containers toward the carrier sleeves and the containers are guided into the open ends of the sleeves by guide rails located on the support surface.

22. A method according to claim 20, wherein the conveyor means move at a slightly faster speed than the speed at which the screw means can move the containers and wherein the surface of the conveyor means supporting the containers is relatively slippery, allowing the containers to slide thereon, whereby the conveyor means positively feed the containers and the screw means provide a metering function.

23. A method according to claim 20, including the additional step of bridging the space between the conveyor means and the support means along the path of travel of the cans when the space is not occupied by a flight bar.

24. A method of feeding containers, a substantial portion of each container being cylindrical in shape, to an open-ended carrier sleeve moving in a downstream direction along a support surface, comprising the steps of:

moving relatively large open-ended carrier sleeves in said downstream direction, moving the containers in a row on inboard conveyors on either side of and generally parallel to the direction of movement of the carrier sleeves, contacting the containers with screw means to separate the containers into groups containing a predetermined number of containers while the containers are being moved by the inboard conveyor means, the containers in each group being intended to fit into the relatively large carrier sleeves, also moving the containers in a row on outboard conveyors spaced outwardly of and arranged parallel to the inboard conveyors, contacting the containers on the outboard conveyor means with screw means to separate the containers into groups containing the same number of containers as the groups on the inboard conveyor means, moving the containers from the inboard and outboard conveyors into the open ends of the relatively large carrier sleeves, ceasing movement of the conveyors, replacing the screw means on the inboard conveyors with screw means which separate the containers into groups having fewer containers than were in the groups formed by the operation of the original screw means associated with the inboard conveyors, moving relatively small carrier sleeves instead of the relatively large carrier sleeves in a downstream direction, resuming operation of the inboard conveyor and the new associated screw means thereof, but not the outboard conveyor and associated screw means thereof, to move the containers and separate the containers into groups containing a predetermined number of containers intended to fit into the relatively small carrier sleeves, and moving the containers from the inboard conveyors into the open ends of the relatively small carrier sleeves.

25. A method according to claim 24, wherein the carrier sleeves are moved by means of a flight bar conveyor, successive flight bars thereof forming a pocket therebetween for holding a carrier sleeve.

26. A method according to claim 25, wherein each inboard conveyor and each outboard conveyor comprises a relatively long conveyor and a relatively short conveyor spaced a short distance downstream therefrom, the flight bar conveyor having an upward run which moves the flight bars between the adjacent ends of the relatively long and short conveyors just prior to beginning the horizontal downstream run thereof, and including the additional step of contacting the last container in each group of containers with a flight bar substantially as the flight bar is changing direction from the upward run thereof to the downstream run thereof.

27. A method according to claim 24, wherein the relatively large carrier sleeves fit into pockets in the flight bar conveyor formed by the space between successive flight bars, the relatively small carrier sleeves being made to fit into the pockets by attaching inserts to the flight bars to decrease the pocket size.

28. A method according to claim 24, wherein the relatively large carrier sleeves fit into pockets in the flight bar conveyor formed by the space between successive flight bars, the relatively small carrier sleeves being made to fit into the pockets by inserting additional flight bars to decrease the pocket size.

* * * * *

UNITED STATES PATENT AND TRADEMARK OFFICE

CERTIFICATE OF CORRECTION

PATENT NO. : 4,693,055

DATED : September 15, 1987

INVENTOR(S) : Peter C. Olsen, JR; Peter M. Conforto, David L. Wolf, Donald R. Hudson It is certified that error appears in the above—identified patent and that said Letters Patent is hereby corrected as shown below:

Column 7, Claim 1, Line 2:
"portion of each container being cylindrical in shape, to"

Column 7, Claim 1, Line 6:
"stream in a row on either side of a generally paral-"

Signed and Sealed this

Third Day of May, 1988

*Attest:*

*Attesting Officer*

DONALD J. QUIGG

*Commissioner of Patents and Trademarks*